United States Patent [19]

Stroh

[11] 3,977,529

[45] Aug. 31, 1976

[54] DISPLAY RACK

[75] Inventor: Alvin L. Stroh, Downey, Calif.

[73] Assignee: McMillin Wire & Plating, Inc., Los Angeles, Calif.

[22] Filed: June 3, 1974

[21] Appl. No.: 475,657

[52] U.S. Cl. ..... 211/187; 211/181

[51] Int. Cl.[2] ..... A47F 5/13

[58] Field of Search ..... 211/148, 149, 177, 181, 211/182, 178 R

[56] References Cited

UNITED STATES PATENTS

| | | | |
|---|---|---|---|
| 1,569,366 | 1/1926 | Goldberg | 211/182 |
| 2,315,595 | 4/1943 | Chappory | 211/148 |
| 2,562,497 | 7/1951 | Klein | 211/181 X |
| 2,803,351 | 8/1957 | Van Wiggeren | 211/148 X |
| 3,225,719 | 12/1965 | Marschak | 211/181 X |
| 3,232,442 | 2/1966 | Wilson | 211/181 X |
| 3,252,434 | 5/1966 | Young | 211/148 X |
| 3,276,400 | 10/1966 | Brunette | 211/148 X |
| 3,435,958 | 4/1969 | Chesley | 211/181 X |
| 3,449,541 | 3/1970 | Mackie | 211/178 R X |
| 3,680,712 | 8/1972 | Jurasek | 211/181 |
| 3,696,763 | 10/1972 | Evans | 211/148 X |

FOREIGN PATENTS OR APPLICATIONS

| | | | |
|---|---|---|---|
| 566,193 | 4/1958 | Belgium | 211/148 |
| A72,200 | 10/1959 | France | 211/148 |
| 636,497 | 3/1962 | Italy | 211/177 |
| 271,064 | 10/1950 | Switzerland | 211/177 |
| 1,082,203 | 9/1967 | United Kingdom | 211/148 |

*Primary Examiner*—Roy D. Frazier
*Assistant Examiner*—Thomas J. Holko
*Attorney, Agent, or Firm*—John T. Matlago

[57] ABSTRACT

A display rack for retail merchandise is formed without a back panel by providing a framework which uses upper and lower rear spreader bars having attachment means on the ends thereof for interconnecting the rear upright posts of a pair of spaced sidewalls. Each sidewall is provided with a plurality of vertically spaced transverse wire support members. Such an arrangement permits wire shelves formed with reinforcing rear walls to be readily mounted on the framework by fastener portions on the sides thereof engaging fastener portions on opposing wire support members of the sidewalls.

4 Claims, 8 Drawing Figures

53
51
90
27
31
80
11
50
15
63
10
65
73
49
3
53
52
3
71
12
53
21
22
23
30
26
23
24
20
49
18
19
49
81
37
38
34
33
36
39
40
43
46
42
45
55
66
54
16
66
64
49
70
72
77
90
56
66
66

53
15
52
90
38
50
58
61
34

10
11
12
15
16
18
19
20
21
22
23
24
26
27
30
31
33
34
36
37
38
39
40
42
43
45
46
49
50
51
52
53
54
55
56
57
58
59
60
63
64
65
66
69
70
71
72
73
74
75
76
77
78
80
81
90
91

6
53
52
90
50
15
53
90
58
12
51
57
65
49
11
64
73
72
80
81
78
71
76
20
36
73
65
19
78
34
71
49
72
76
5

53
15
53
42
36
37
12
52
58
39
43
34
38
64
45
46
65
49
71
71
77
40
78
64
49
71
71
78
77

53
52
50
15
8
51
91
91
8
36
49
20
89
88
11
12
19
34
92
93
49
16
54
55
91
91
66
56
66

69
49
70
71
72
42
37
33
64
77
38
39
36
45

DISPLAY RACK

This invention relates to shelf structures and more particularly to an improved rack for displaying retail merchandise.

The framework of racks for displaying any of a variety of retail merchandise such as bags of potato chips and similar foodstuffs in supermarkets and the like are usually constructed with a back panel. The back panel provides lateral rigidity to the framework and also serves to retain and support in an upright position the bags of foodstuffs being carried on the shelves mounted on the framework. Inasmuch as the back panel covers a large area it must necessarily be made in sections so that when the rack is disassembled or "knocked down" the sections will be no larger than the other component assemblies such as the sidewalls or the shelves. This complicates the design of the back panel and makes it more difficult to assemble on the framework of the display rack. Furthermore, it is common practice to adapt the framework for the display rack to enable shelves of different lengths to be mounted thereon. Such a requirement necessitates the providing of different sets of back panels for the different length shelves. It is thus apparent that a substantial portion of the material and labor costs for manufacturing a display rack of the prior art is in the back panels therefor.

Accordingly, one of the objects of the present invention is to provide an improved shelf structure for the display of retail merchandise which does not require a back panel.

Another object of the present invention is to provide a display rack formed of a few compact fabricated component units which can be quickly and easily assembled and disassembled without the need of any tools.

Another object of the present invention is to provide a display rack that is economical to produce.

Another object of the present invention is to provide a framework for a display rack which is more stable when self-standing and which permits the shelves to be readily repositioned as to the level at which they are held on the framework even when the shelves are filled with merchandise.

With these and other objects in view, the invention consists in the construction, arrangement and combination of the various parts of the device whereby the objects contemplated are attained as hereinafter set forth, pointed out in the appended claims and illustrated in the accompanying drawings.

Figure 1:
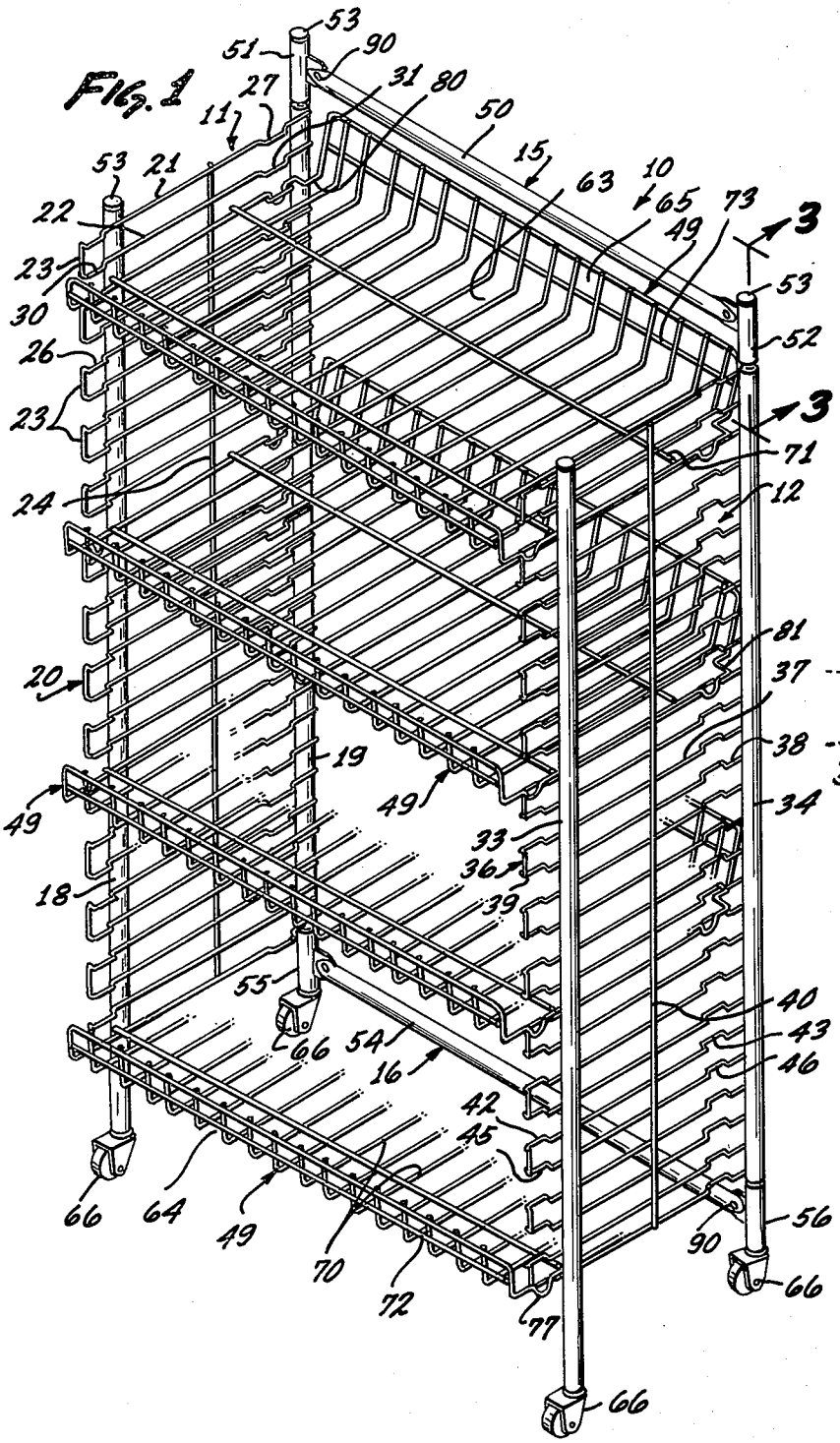
FIG. 1 shows an overall perspective view of the improved display rack of the present invention.

Referring to the drawings, the display rack of the present invention includes a framework 10 comprised of spaced, opposing, sidewalls 11 and 12 which are held in a sturdy upright position by an upper spreader bar 15 and a lower spreader bar 16 pivotally attached to the rear posts of the sidewalls.

Figures 2, 8:
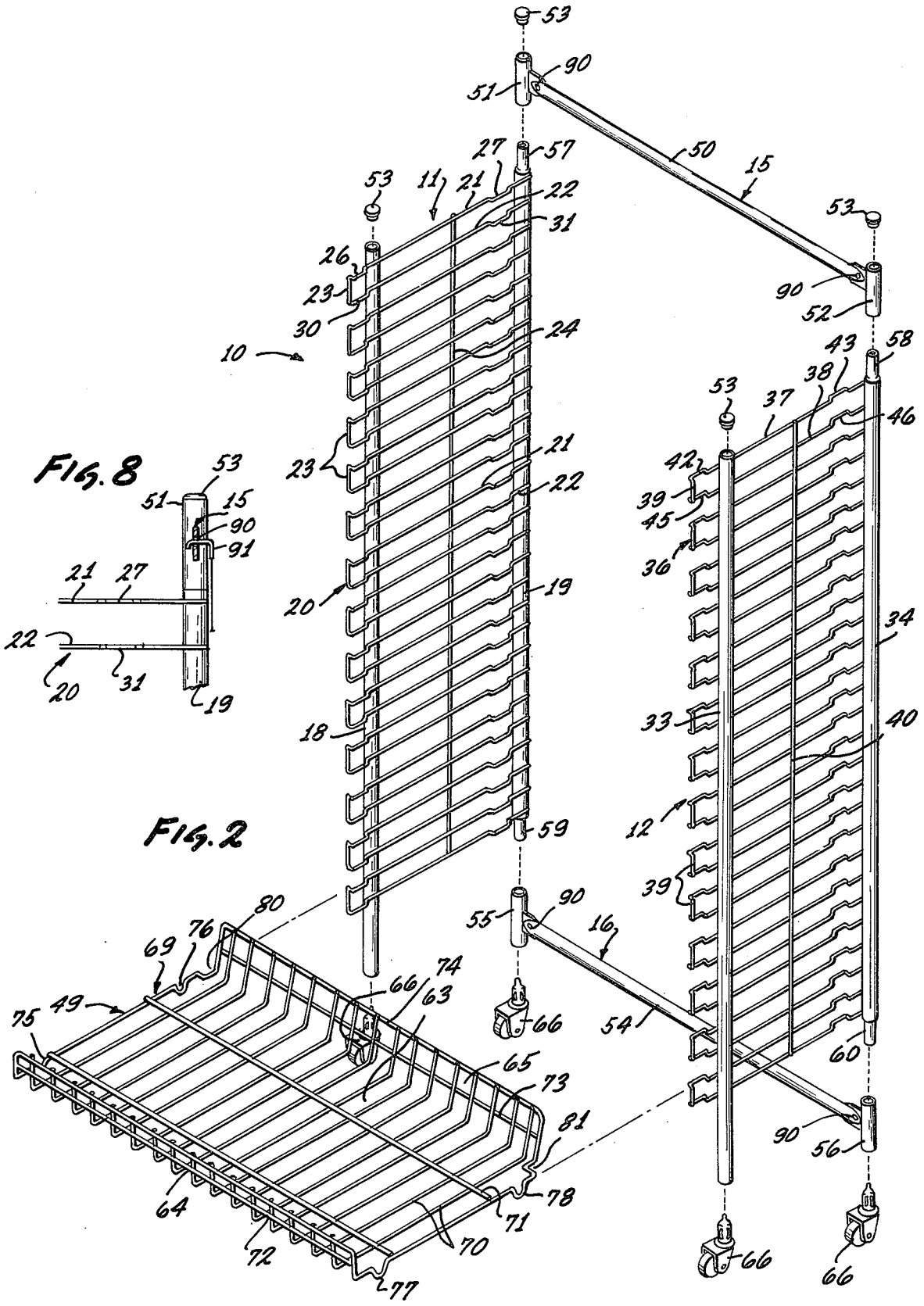
FIG. 2 is an exploded view of the framework and a wire shelf supported thereon.
FIG. 8 is a sectional view as taken along lines 8—8 of FIG. 7.

The sidewall 11 consists of spaced front and rear upright tubular posts 18 and 19 which are connected together by a plurality of spaced, horizontally disposed, U-shaped, wire support members 20. As shown in FIG. 2, each support member 20 includes upper and lower transverse portions 21 and 22 connected at their forward ends by a vertical portion 23. The upper transverse portion 21 is integrally formed with a pair of spaced, laterally inwardly extending, front and rear loop portions 26 and 27. Likewise, the lower transverse portion 22 is integrally formed with a pair of spaced, laterally inwardly extending, front and rear loop portions 30 and 31. A vertical reinforcing wire member 24 is connected to the wire members 20 intermediate the posts 18 and 19.

The sidewall 12 similarly consists of spaced front and rear upright tubular posts 33 and 34 which are connected together by a plurality of spaced, horizontally disposed, U-shaped, wire support members 36. As shown in FIG. 2, each support member 36 includes upper and lower transverse portions 37 and 38 connected at their forward ends by a vertical portion 39. The upper transverse portion 37 is integrally formed with a pair of spaced, laterally inwardly extending, front and rear loop portions 42 and 43. Likewise, the lower transverse portion 38 is integrally formed with a pair of spaced, laterally inwardly extending, front and rear loop portions 45 and 46. A vertically reinforcing wire member 40 is connected to the wire members 36 intermediate the posts 33 and 34.

Each of the loop portions integrally formed on the support members 20 and 36 is in the shape of a substantially rectangular offset in that the corners are relatively sharp and the straight back portion of the loop extends parallel to the wire support member. The front loop portions 26 and 30 on the sidewall 11 are located just forward of the post 18, and the rear loop portions 27 and 31 are located just forward of the rear post 19. Likewise the front loop portions 42 and 45 on the sidewall 12 are located just forward of the front post 33 and the rear loop portions 43 and 46 are located just forward of the rear post 34. Such an arrangement provides for a maximum spacing of the front and rear loop portions on the support members, and, therefore, provides for a more stable supporting of the shelves 49 on the framework 10. As will be hereinafter described, the pairs of loop portions provided at the same levels on the respective sidewalls 11 and 12 serve as interengaging portions to engage pairs of similarly spaced depending lug portions provided on the ends of wire shelves 49.

Figure 3:
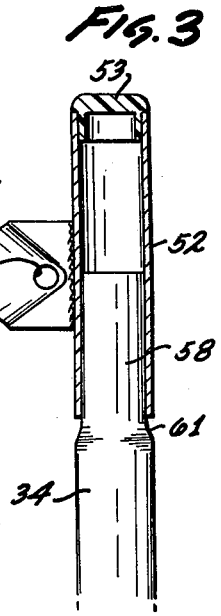
FIG. 3 is a sectional view as taken along lines 3—3 in FIG. 1.

As shown in FIGS. 2 and 3, the upper spreader bar 15 includes a horizontal tubular member 50 having vertically disposed tubular elements 51 and 52, respectively, attached to the opposite ends thereof. The ends of tubular member 50 are preferably flattened and welded to the tubular elements 51 and 52 intermediate the length thereof and with the axes of the tubular elements 51 and 52 disposed at 90 degrees to the axis of tubular member 50. The lower halves of the tubular elements 51 and 52 define elongated sockets which slideably fit over the reduced diameter, elongated upper end portions 57 and 58 on the rear upright posts 19 and 34, respectively. As shown in FIG. 3, the reduced diameter upper end portion of post 34 extends into the elongated socket formed by the lower half of the tubular element 52 with the lower end of the element 52 resting on shoulder 61.

Likewise, the lower spreader bar 16 includes a horizontal tubular member 54 having vertically disposed tubular elements 55 and 56, respectively attached to the opposite ends thereof and with the axes of tubular elements 55 and 56 disposed at 90 degrees to the axis of tubular member 54. The upper portions of tubular elements 55 and 56 define elongated sockets which slideably fit over the reduced diameter lower end portions 59 and 60 on the rear upright posts 19 and 34, respectively. Such an interconnection of the sidewalls 11 and 12 to the spreader bars 15 and 16 provides a mechanical resistance to lateral distortion of the framework 10. As is apparent, such an interconnection also provides a sturdy self-standing framework 10 when the sidewalls are swung about their rear pivot connections on the spreader bars to face each other.

It should be noted that the lower ends of the rear upright posts 19 and 34 are shorter than the front upright posts 18 and 33 such that when the tubular elements 55 and 56 on the ends of the lower spreader bar 16 are fitted on to the lower ends of upright posts 19 and 34 the bases of the legs so provided on the sidewalls 11 and 12 are at the same level. The bases of the legs of the sidewalls may either engage the floor whereby the shelf structures is stationary, or, as shown in FIGS. 1 and 2, the bases may be provided with casters 66 whereby the rack becomes mobile. In either event the sidewalls 11 and 12 are supported in an upright position while their rear posts 19 and 34 are permitted to be pivoted about the upper and lower tubular elements 51 and 55 and 52 and 56 of the upper and lower spreader bars 15 and 16. Caps 53 are inserted on the open upper ends of the front upright posts 18 and 33 and also on the open upper ends of the tubular elements 51 and 52 on the upper spreader bar 15.

A plurality of wire shelves 49 of identical construction are mounted on the supporting framework 10. As shown in FIG. 2, an outer frame 69 fabricated from a single length of relatively heavy gauge wire defines the periphery of the shelf to include a flat bottom wall 63, an upwardly extending front wall 64, and an upwardly extending rear wall 65. The ends of the wire forming the outer frame 69 are joined by welding at point 74 of the rear wall 65. As will be clearly described hereinafter, the rear wall 65 extends upwardly approximately two to three times as high as the front wall 64 since it is being provided in lieu of a conventional back panel as a surface against which the bags of foodstuffs on the shelf tend to lean. Attached to the longitudinal portions of the outer frame 69 transversely along the length thereof are a plurality of regularly spaced light gauge wire elements 70 each having a shape corresponding to the side of the shelf as defined by the outer frame 69. To reinforce the wire elements 70 on shelf 49, a pair of spaced longitudinally extending heavy gauge wire members 71 are provided on the horizontal plane of the outer frame 69 forming the bottom wall 63 thereof. In addition, a longitudinally extending similar gauge wire member 72 is provided on the front wall 64 thereof, and another 73 is provided along the rear wall 65 thereof. It should be clear that the wire shelves 49 are designed to be sufficiently rigid by the truss effect obtained by welding the reinforcing wire members 72 and 73 on the respective front and rear walls 64 and 65 such that the shelves can be rigidly, fully supported by having their ends only engaging the support members 20 and 36 on the sidewalls 11 and 12.

Figure 5:
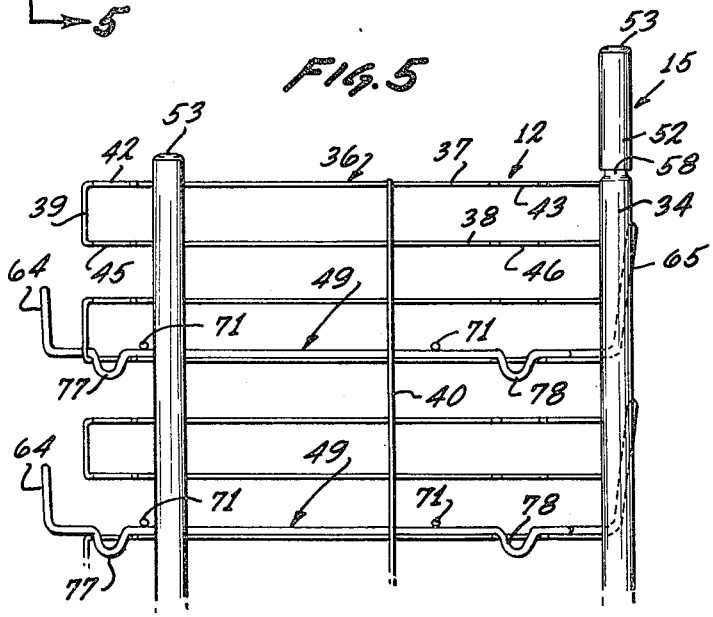
FIG. 5 is a partial side view of the display rack as taken along lines 5—5 of FIG. 4.
Figure 6:
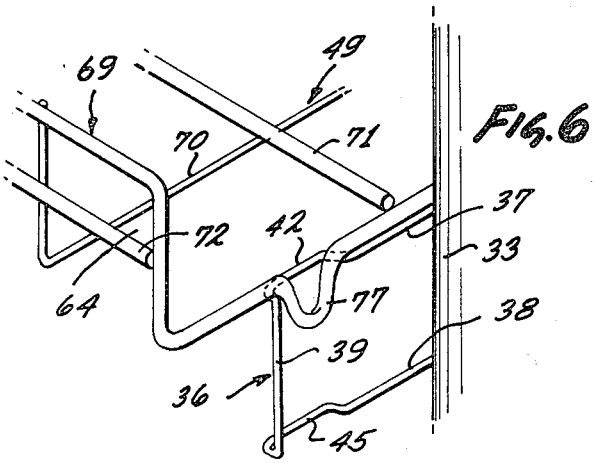
FIG. 6 is a partial perspective view of the attachment of the wire shelf to the sidewall of the framework.

The left end of the outer frame 69 of the wire shelf 49 is integrally formed with a pair of spaced depending lug portions 75 and 76. Similarly, the right side of the outer frame 69 is integrally formed with a pair of spaced depending lug portions 77 and 78. As best illustrated in FIGS. 5 and 6, each depending lug portion is in the form of an extended rounded depending projection.

The depending lug portions 75 and 76 on one side and lug portions 77 and 78 on the other side of the shelf 49 are adapted to interengage with the similarly spaced lateral loop portions, such as 26 and 27, and 42 and 43, on the support members 20 and 36 of the respective sidewalls 11 and 12, to fix the shelf 49 in position on the framework 10. As shown in detail in FIG. 6, when the depending lug portion 77 is engaged in the loop portion 42 of support member 36, the side of the wire frame 69 rests on the transverse portion 37 of member 36. The pairs of depending lug portions 75 and 76, and 77 and 78, of shelf 49 may similarly be positioned to interengage with any of the opposing pairs of lateral loop portions 30 and 31, and 45 and 46, on the respective support members 20 and 36 of the sidewalls 11 and 12, depending on the particular horizontal level at which it is desired to position a particular shelf 49.

It is thus apparent that the shelves 49 are adapted to be mounted on the supporting framework 10 with their side pairs of depending lug portions disposed within the pairs of opposing lateral loop portions formed on the respective sidewalls 11 and 12 whereby the shelves 49 are held in the proper operative position while the overall display rack is maintained in a sturdy, erected, upright position.

It should be especially noted that the side portions of outer wire frame 69 of the shelf 49 have inwardly bent rear corner portions 80 and 81 formed thereon just before being bent upwardly to define outer edges of the rear wall 65. Thus, both sides of the rear wall 65 of the shelf are recessed inwardly resulting in the rear wall 65 of the shelf being made narrower than the front wall 64 thereof to allow for clearance of the rear wall past the lateral loop portions on support members 20 and 36 on the sidewalls 15 and 16 (FIG. 4) when the shelf is being mounted on the framework 10.

A particularly important feature of the present invention is the fact that any or all of the shelves 49 can be readily assembled or disassembled or repositioned on the framework 10 while the latter is self-standing. Thus, by pivotally interconnecting the rear upright posts of sidewalls 11 and 12 to the respective ends of upper and lower spreader bars 15 and 16, a self-standing framework 10 is provided which permits the sidewalls 11 and 12 to be swung toward each other to receive the sides of a shelf 49. After one of the shelves 49 has been mounted in any position on the sidewalls 11 and 12, the sidewalls are fixed in position relative to the spreader bars 15 and 16 and the framework 10 is therefore held in a sturdy, rigid, fixed, erected position. Additional shelves 49 can then be readily positioned on the fixed framework 10, as desired, each shelf serving to further rigidify the framework.

Figure 4:
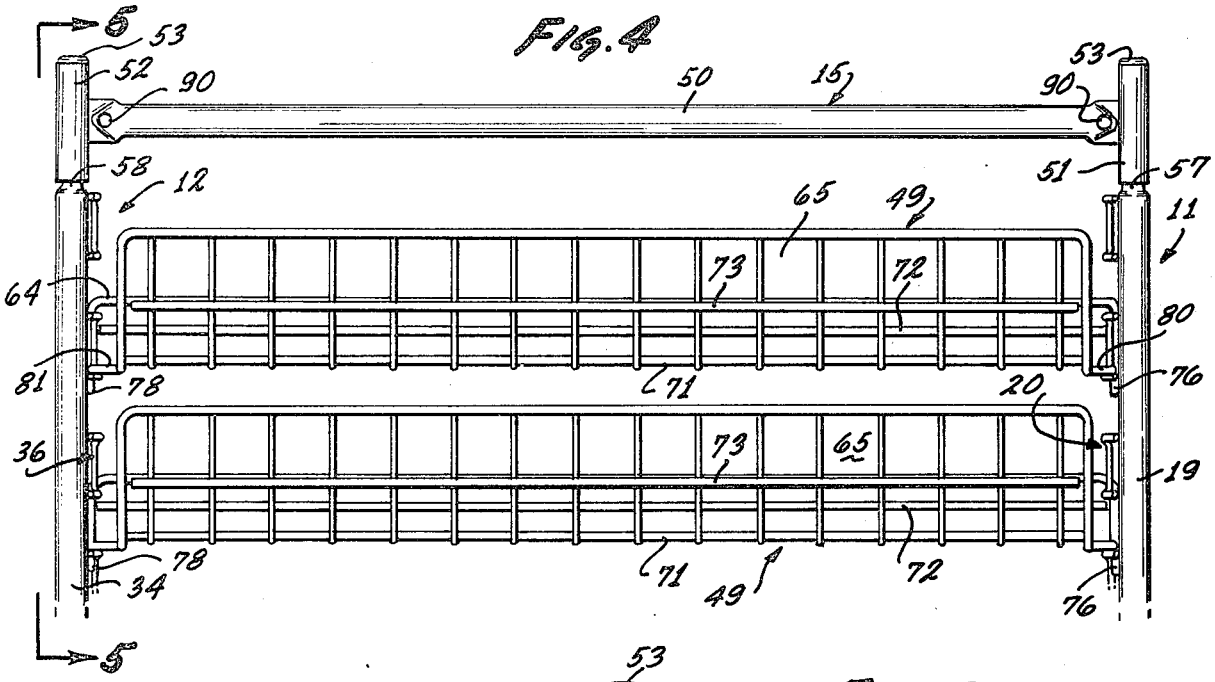
FIG. 4 is a partial rear view of the display rack of FIG. 1.

It should now be clearly understood that the display rack of the present invention is formed without any back panels thereon. It should likewise be now clear that the shelves 49, when mounted on the framework 10, as shown in FIGS. 4 and 5, have their upwardly extending rear walls 65 located between and generally in the plane of the rear posts 19 and 34. The rear wall 65 thus serves to retain the goods on the shelf and thus effectively takes the place of the rear panel usually provided on the framework of prior art shelving structures. The rear wall, along with the front wall 64, also provides the truss support to carry the weight of the items carried on the shelf.

Note that the upper and lower spreader bars 15 and 16 are identically constructed, the sidewalls 11 and 12 are identically constructed except for the location of the U-shaped wire support members on the inside face of the tubular posts of the left and right sidewalls, and the wire shelves 49 are, likewise, identically constructed. Thus, the display rack of the present invention is comprised of only these three types of fabricated component units, namely, the sidewalls, the spreader bars and the shelves. It should be further noted that in order to accomodate shelves of different lengths, the spreader bars must be provided in similarly different lengths. However, providing such a set of spreader bars is much less expensive than providing different sets of back panels as in the prior art.

To assemble the rack structure, the two sidewalls 11 and 12 are placed in a position with the rear upright posts 19 and 34 thereof spaced sufficiently apart to receive on the lower reduced diameters 59 and 69 thereof the sockets formed by the tubular elements 55 and 56 on the ends of lower spreader bar 16. Similarly, the upper reduced diameter ends 57 and 58 thereof receive the sockets formed on the tubular elements 54 and 56 on the ends of the upper spreader bar 15. To mount the shelves 49 on the framework, the pairs of depending lug portions on the sides thereof are received on the pairs of opposing lateral loop portions formed on the horizontal extending wire support members on the pair of sidewalls. In order to mount the first shelf on the framework 10, the sidewalls 11 and 12 can be pivoted on their upright posts to receive the depending side lug portions of one of the shelves 49 on the lateral loop portions of their support members 20 and 36. The additional shelves can then be mounted on the members 20 and 36 at the desired levels. It should be noted that the assembly of the display rack takes place quickly without the use of tools or equipment of any kind.

When it is desired to disassemble the rack structure, the shelves 49 are first removed from the framework 10 by lifting their side lugs portions up out of the engaging loop portions on the wire support members 20 and 36 attached to the respective sidewalls 11 and 12. The upper and lower spreader bars 15 and 16 can then be removed from the ends of the rear posts 19 and 34. The sidewalls 11 and 12, the spreader bars 15 and 16, and the shelves 49 can then be stacked together in a compact manner for storage until again needed or to accomodate shipping.

Figure 7:
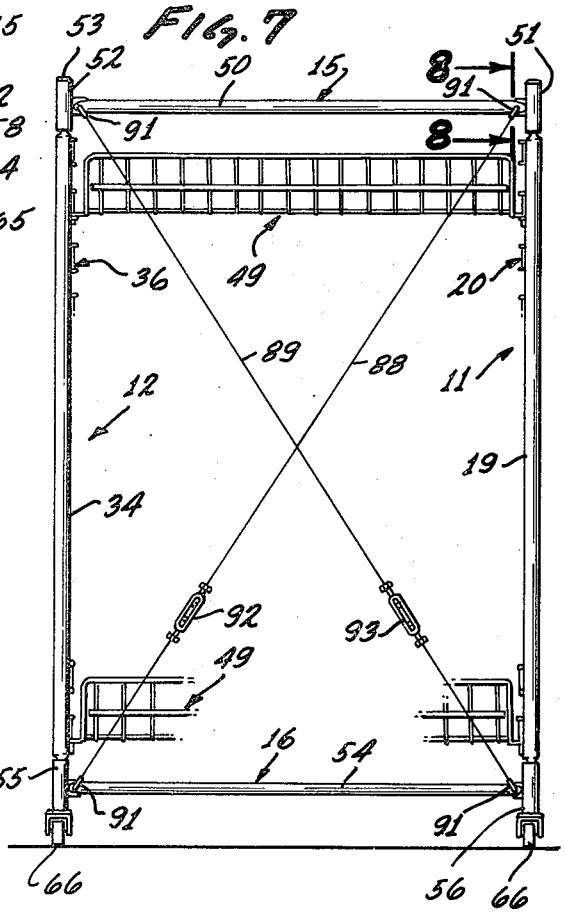
FIG. 7 is a back view of the display rack showing a modification thereof.

Reference will next be made to FIG. 7 which shows a modification of the display rack. When the display rack is loaded down with heavy goods on the shelves thereof, when the length of the shelves 49 employed are excessively long, or when it becomes desirable that the framework 10 of the rack must positively not come apart, the display rack framework 10 can be additionally strengthened against lateral distortion by means of the cross wires 88 and 89. The tubular members 50 and 54 on the spreader bars 15 and 16 have holes 90 provided on the ends thereof. The cross wires 88 and 89 are provided with hooks 91 (FIG. 8) on the ends thereof which engage in the holes 90 so that each cross wire can interconnect diagonally opposite corners of the back of the framework. The turnbuckles 92 and 93 on the respective wires 88 and 89 can be tightened as needed to give the desired restraint to lateral distortion caused by the heavy load on the shelves or to separation of the spreader bars as may be caused by a lifting of the rack. Note that it is because the framework of the present invention is provided with elongated socket attachments on the ends of the upper and lower spreader bars 15 and 16 thereof, and the four sides of the back of the framework are formed of stiff members, that such a cross wire bracing arrangement as shown in FIG. 7 can be provided to rigidify the framework against lateral distortion when under a severe loading operating condition, or against a separation when subject to a lifting motion.

It should now be clear that the providing of a display rack for retail merchandise that does not have a back panel is highly advantageous since it greatly reduces the production cost of the rack by eliminating the material used for the back panel, as well as the complexity of its manufacture which is caused by requiring the rear panel to be made in sections so that it can be compactly handled for shipment. Furthermore, the spreader bars used in the present invention are much simpler to design and can be provided in sets of different lengths to match different length shelves at a much reduced cost as compared to sets of back panels provided on conventional shelving structures.

The fact that the wire shelf of the present invention is provided with a rear wall gives rigidly to the shelf which simplifies the mounting thereof such that the shelf can be supported by having its sides only engaged on the sidewall of the framework. Such a mounting arrangement of the shelf is of further advantage in that it makes it easier to mount and dismount the shelf from the framework and this, along with the providing of a rear wall on the shelf, makes it possible for a store clerk to reposition a shelf on the framework while it still has the products thereon. A still further advantage of the open back of a display rack of the present invention is that it enables the store clerk in a supermarket or the like to have access to the rear of the shelves thereof thus permitting him to more easily place new bags of foodstuffs in the rear of shelves partly filled with older bags so that the foodstuffs will be sold in rotation.

While the description has been concerned with a particular structural embodiment of the present invention, it is to be understood that many modifications and variations in the construction and arrangement may be provided for without departing from the spirit and scope of the invention or sacrificing any of its advantages. The invention is therefore considered as including all such possible modifications and variations coming within the legitimate and valid scope of the appended claims.

What is claimed is:

1. A display rack comprising:

a pair of oppositely disposed sidewalls, each said sidewall including spaced front and rear upright posts interconnected by a plurality of generally horizontally disposed vertically spaced wire support elements, each said support element having a pair of spaced horizontally inwardly extending offset portions;

upper and lower longitudinally extending spreader bars;

upright socket means secured on the ends of said upper spreader bar for receiving the upper ends of the rear upright posts of the sidewalls;

upright socket secured on the ends of said lower spreader bar for receiving the lower ends of the rear upright posts of the sidewalls; and at least one wire shelf having a generally upright rear wall and a pair of opposite side edge portions, each of the opposite side edge portions of said wire shelf having a pair of spaced vertically downwardly extending lug portions, the rear wall of said wire shelf being recessed inwardly at each side portion thereof to facilitate positioning of said shelf between the sidewalls during the mounting thereof in operative position on said rack with the lug portions on the opposite side edge portions thereof engaging offset portions on oppositely disposed wire support elements on said sidewalls.

2. The invention in accordance with claim 1 wherein the rear upright posts are provided with reduced diameter upper and lower end portions; and wherein the upright socket means on the ends of said upper and lower spreader bars are tubular.

3. A display rack comprising:

a pair of oppositely disposed sidewalls, each said sidewall including spaced front and rear upright posts interconnected by a plurality of generally horizontally disposed vertically spaced wire support elements, each said support element having a pair of spaced horizontally inwardly extending offset portions;

upper and lower longitudinally extending spreader bars;

upright socket means secured on the ends of said upper spreader bar for receiving the upper ends of the rear upright posts of the sidewalls;

upright socket means secured on the ends of said lower spreader bar for receiving the lower ends of the rear upright posts of the sidewalls, the lower ends of the rear upright posts of said sidewalls being shortened so that they will be of the same length as the front upright posts when received in the upright socket means on the ends of the lower spreader bar; and at least one wire shelf having a generally upright rear wall and a pair of opposite side edge portions, each of the opposite side edge portions of said wire shelf having a pair of spaced vertically downwardly extending lug portions, said wire shelf being held in operative position on said rack by interengaging the pair of lug portions on the opposite edge portions thereof with the pair of offset portions on oppositely disposed wire support elements on said sidewalls.

4. The invention in accordance with claim 3 wherein said wire shelf has the upright rear wall thereof recessed inwardly at each side portion thereof to facilitate positioning of said shelf between the sidewalls during the mounting thereof.

* * * * *